US007269384B2

(12) United States Patent
Someya et al.

(10) Patent No.: US 7,269,384 B2
(45) Date of Patent: Sep. 11, 2007

(54) TRANSFER-FIXING UNIT WITH A SURFACE LAYER OF PREDEFINED HARDNESS FOR USE IN AN IMAGE FORMING APPARATUS

(75) Inventors: Yukimichi Someya, Saitama (JP); Takashi Fujita, Yokohama (JP); Atsushi Nakafuji, Ota-ku (JP); Katsuhiro Echigo, Asaka (JP); Hiroyuki Kunii, Yokohama (JP); Shigeo Kurotaka, Sagamihara (JP); Hisashi Kikuchi, Kawasaki (JP); Toshihiko Baba, Ota-ku (JP); Kohji Ue, Kawasaki (JP); Hiromitsu Takagaki, Yokohama (JP); Hirohmi Tamura, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/177,330

(22) Filed: Jul. 11, 2005

(65) Prior Publication Data

US 2006/0008302 A1 Jan. 12, 2006

(30) Foreign Application Priority Data

Jul. 9, 2004 (JP) ..... 2004-202759
Feb. 1, 2005 (JP) ..... 2005-025699

(51) Int. Cl.
*G03G 15/20* (2006.01)

(52) U.S. Cl. ..... 399/307

(58) Field of Classification Search ..... 399/307
See application file for complete search history.

(56) References Cited

U.S. PATENT DOCUMENTS 4,985,733 A 1/1991 Kurotori et al.
4,987,457 A 1/1991 Mochizuki et al.
5,359,398 A 10/1994 Echigo et al.
5,592,275 A 1/1997 Echigo et al.
5,642,188 A 6/1997 Mochizuki et al.

(Continued)

FOREIGN PATENT DOCUMENTS

JP 5-19642 1/1993

(Continued)

OTHER PUBLICATIONS

Computer translation of JP2003-98871A.*

(Continued)

*Primary Examiner*—Quana Grainger
(74) *Attorney, Agent, or Firm*—Oblon, Spivak, McClelland, Maier & Neustadt, P.C.

(57) ABSTRACT

A transfer-fixing unit for use in an image forming apparatus having an intermediate transfer member and a transfer-fixing unit, which includes a pressure member and a transfer-fixing member. The intermediate transfer member receives a toner image thereon. The transfer-fixing member has a deformable surface layer thereon, and directly receives the toner image from the intermediate transfer member, and transfers and fixes the toner image to a recording medium while deforming the surface layer in response to surface irregularities of the recording medium. The transfer-fixing member forms a nip portion with the pressure member and presses the recording medium at the nip portion when the recording medium passes through the nip portion with a nip time.

22 Claims, 6 Drawing Sheets

U.S. PATENT DOCUMENTS

| | | | | |
|---|---|---|---|---|
| 5,678,161 | A | 10/1997 | Kurotaka et al. | |
| 5,708,949 | A | 1/1998 | Kasahara et al. | |
| 5,708,950 | A * | 1/1998 | Badesha et al. | 399/333 |
| 6,055,390 | A | 4/2000 | Kurotaka et al. | |
| 6,088,558 | A | 7/2000 | Yamada et al. | |
| 6,122,479 | A | 9/2000 | Fujita et al. | |
| 6,198,888 | B1 | 3/2001 | Kurotaka et al. | |
| 6,243,559 | B1 | 6/2001 | Kurotaka et al. | |
| 6,501,935 | B2 | 12/2002 | Hirai et al. | |
| 6,529,701 | B2 * | 3/2003 | Baba et al. | 399/307 |
| 6,535,701 | B2 | 3/2003 | Baba | |
| 6,542,705 | B2 | 4/2003 | Fujita et al. | |
| 6,559,421 | B1 | 5/2003 | Yura et al. | |
| 6,631,253 | B2 | 10/2003 | Nakafuji et al. | |
| 6,636,718 | B2 | 10/2003 | Yura et al. | |
| 6,646,227 | B2 | 11/2003 | Yura et al. | |
| 6,721,532 | B2 | 4/2004 | Kosugi et al. | |
| 6,741,825 | B2 * | 5/2004 | Omata et al. | 399/309 |
| 6,795,676 | B2 | 9/2004 | Kikuchi et al. | |
| 6,795,678 | B2 | 9/2004 | Yura et al. | |
| 6,810,228 | B2 * | 10/2004 | Kiuchi et al. | 399/307 |
| 6,847,792 | B2 | 1/2005 | Nakafuji et al. | |
| 6,941,088 | B2 | 9/2005 | Atsushi et al. | |
| 7,024,923 | B2 * | 4/2006 | Aze et al. | 73/81 |
| 2003/0235441 | A1 * | 12/2003 | Park | 399/307 |
| 2004/0022552 | A1 * | 2/2004 | Yura et al. | 399/69 |
| 2004/0037595 | A1 | 2/2004 | Takashi et al. | |
| 2004/0111888 | A1 | 6/2004 | Yura et al. | |
| 2004/0190947 | A1 | 9/2004 | Takeuchi et al. | |
| 2004/0245235 | A1 | 12/2004 | Kishi et al. | |
| 2004/0265017 | A1 | 12/2004 | Kikuchi et al. | |
| 2005/0025534 | A1 | 2/2005 | Fujita et al. | |
| 2005/0025537 | A1 | 2/2005 | Echigo et al. | |
| 2005/0117943 | A1 | 6/2005 | Nakafuji et al. | |
| 2005/0152721 | A1 | 7/2005 | Kikuchi et al. | |
| 2006/0008302 | A1 | 1/2006 | Someya et al. | |

FOREIGN PATENT DOCUMENTS

| | | |
|---|---|---|
| JP | 5-249798 | 9/1993 |
| JP | 9-281836 | 10/1997 |
| JP | 3042414 | 3/2000 |
| JP | 3095480 | 8/2000 |
| JP | 2000-292986 | 10/2000 |
| JP | 2000-305385 | 11/2000 |
| JP | 2002-365934 | 12/2002 |
| JP | 2003-98871 | 4/2003 |
| JP | 2003-254324 | 9/2003 |
| JP | 2003-280434 | 10/2003 |
| JP | 2004-145260 | 5/2004 |
| JP | 2004-170692 | 6/2004 |

OTHER PUBLICATIONS

U.S. Appl. No. 11/521,494, filed Sep. 15, 2006, Takagaki et al.
U.S. Appl. No. 11/511,380, filed Aug. 29, 2006, Suzuki et al.
U.S. Appl. No. 11/669,817, filed Jan. 31, 2007, Suzuki et al.
U.S. Appl. No. 11/681,739, filed Mar. 2, 2007, Seto et al.
U.S. Appl. No. 11/683,086, filed Mar. 7, 2007, Takemoto et al.

* cited by examiner

TRANSFER-FIXING UNIT WITH A SURFACE LAYER OF PREDEFINED HARDNESS FOR USE IN AN IMAGE FORMING APPARATUS

TECHNICAL FIELD

The following disclosure relates generally to a fixing unit provided in an image forming apparatus such as copying machine, printer, facsimile employing an electro-photography method and toners.

BACKGROUND

Generally, an image forming apparatus such as copying machine, facsimile, printer or the like transfers an image (e.g., toner image) to a recording medium such as paper sheet, and fixes the image on the recording medium by applying heat to the recording medium to produce an copy print or a record print.

Such image forming apparatus uses a fixing unit to fix the image on the recording medium. In the fixing unit, heat is applied to the recording medium having an unfixed toner image to melt a developing agent and toners included in the unfixed image to fix the toner image on the recording medium.

However, such image forming process may experience degradations on an image to be produced on the recording medium.

For example, the recording medium such as paper has surface irregularities. Because of such surface irregularities, the recording medium and an image carrying member (e.g., photoconductive drum) may not contact closely but have gaps between their surfaces. Such gaps may disturb a transferring-electric field, or may induce Coulomb repulsion between toners. Consequently, such phenomenon may cause degradations on an image to be produced on the recording medium.

In order to cope with such drawbacks, a background art employs a method using an intermediate transfer member driven by a drive roller having a heat source therein, and the intermediate transfer member forms a nip with a pressure member which is pressed to the intermediate transfer member.

In such method, toner images on the intermediate transfer member are heated before the toner images enters the nip, and the heated toner images are fixed on the recording medium at the nip.

Therefore, toner images are transferred from the intermediate transfer member to the recording medium with a heat effect instead of an electrostatic force. Accordingly, the above-mentioned image-quality degradations may less likely to happen on the recording medium.

In order to realize a favorable transferability of toner images from an intermediate transfer member or photoconductive member to a recording medium in such method, the intermediate transfer member or the photoconductive member having a toner image thereon is heated and pressed with a recording medium at first.

Then, the intermediate transfer member or the photoconductive member, the toner image, and the recording medium are contacted and cooled a predetermined time.

And then, the recording medium having the toner image is separated from the intermediate transfer member or photoconductive member.

Such method facilitates a separation of the toner image from the intermediate transfer member or photoconductive member because of such cooling process, thereby a hot-offset of toners can be prevented, wherein the hot-offset is a phenomenon that a part of toners remain on the intermediate transfer member or photoconductive member.

Furthermore, such method can omit a process of applying oily material on the intermediate transfer member or photoconductive member, which is used to facilitate a separation of the toner image from the intermediate transfer member or photoconductive member, thereby such method can favorably realize an oil-less process.

As for a transfer unit and a fixing unit, following background arts can be cited.

One background art uses a fixing belt having an average surface hardness of 0.826 $N/mm^2$ to 2.078 $N/mm^2$, which is measured by a universal hardness testing at an indentation depth of 20 μm.

Another background art uses a fixing belt having another surface hardness expressed with a predetermined formula for universal hardness testing at indentation depths of 4 μm and 20 μm.

Other background arts use an intermediate transfer belt which conducts a transfer and fixing process substantially at the same time Other background arts also includes a method using a transfer-fixing unit, which has a heater and a heat roller having a movable reflection plate.

Other background arts further includes an image forming apparatus having an intermediate transfer belt, transfer and fixing roller, and a heat source for heating a surface of the fixing roller.

Other background arts further includes a method using a transfer-fixing unit having a heat source for heating a surface of a fixing roller and a reflection plate.

Other background arts further includes a method using a pre-heating unit provided for a heat roller for fixing, an infrared lamp, a reflection mirror, a reflection plate which can adjust its reflection angle and illuminate a face of the recording medium.

The above-mentioned methods used in the background arts conduct a transferring process and a fixing process at the same time for image forming, and such methods can prevent degradations of halftone-image quality in a middle and high concentration range, wherein the degradations in a middle and high concentration range may be caused by a disturbance of toner image or Coulomb repulsion of toners.

However, in a low concentration range, surface irregularities of a recording medium affect on image quality.

For example, toners may not transfer to recessed irregularities on a surface of the recording medium because recessed irregularities may not contact toners.

Accordingly, when the recording medium having a rough surface is used, degradations on images may not be improved in the above-mentioned methods.

As for the middle and high concentration range, when a low-speed operation is conducted for the transfer and fixing process, a favorable image having a uniform glossiness and no-disturbance of pixels may be obtained.

However, when a high-speed operation is conducted for the transfer and fixing process for the middle and high concentration range, transferability of the toner images may degrade.

In such transfer and fixing process, the intermediate transfer member, toner images and the recording medium (e.g., paper) are closely contacted each other and heated, and then the melted toners permeate in the recording medium (e.g., paper), and toner image is fixed on the recording medium (e.g., paper).

However, if the intermediate transfer member has a hard surface, such hard surface may not deform in response to tiny surface irregularities of the recording medium (e.g., paper) when fixing toner images.

Therefore, the intermediate transfer member and the recording medium may not contact closely each other, thereby image-quality degradations such as unevenness of glossiness may happen.

In order to improve quality of images produced by such transferring and fixing process, the intermediate transfer member may need an elastic layer on its outer surface so that the intermediate transfer member can contact closely to the recording medium (e.g., paper) having the toner images.

If the intermediate transfer member does not include an elastic layer on its outer surface, the surface of the intermediate transfer member may not deform in response to tiny surface irregularities on the recording medium (e.g., paper) when fixing the toner images.

IN such a case, the intermediate transfer member and the recording medium cannot contact closely each other, thereby image-quality degradations may happen due to a poor transferability.

Conventionally, in order to reduce the above-mentioned drawbacks, several attempts have been made by paying attention to rubber hardness (e.g., Japan Industrial Standard-A hardness) of the surface of the fixing member.

However, as above-mentioned, image-quality degradations may also happen when a lower pressure is applied to a nip in the fixing process. Therefore, in order to prevent image-quality degradations, it is understand that a higher pressure is required at the nip.

Because a higher pressure may induce a warping of the fixing member, the fixing member may need a core material (e.g., metal) having a relatively higher stiffness, which may be prepared by adjusting a diameter or a thickness of the core material (e.g., metal).

If the diameter or thickness of the core material (e.g., metal) is set a larger value, the core material has a larger heat capacity.

In such a case, the fixing member needs longer time to increase its temperature to a predetermined temperature. Hereinafter, such duration time is referred as "rising-time."

The "rising-time" of the fixing member can be made shorter by maintaining the temperature of the fixing member at a certain level by pre-heating the fixing member. However, such method is not preferable in view of the energy saving.

On one hand, in order to obtain a higher quality image with a transfer-and-fixing method, the intermediate transfer member and the recording medium should be contacted closely and cooled for a predetermined time after the transfer and fixing process because such cooling process effects a transferability-efficiency of toner images. However, such cooling process may require a larger machine and may increase cost of components.

Furthermore, because the temperature-increased intermediate transfer member should be cooled, a re-heating is required for the intermediate transfer member for a next image forming.

Accordingly, the "rising-time" of the intermediate transfer member becomes longer, and an energy-consumption increases because of such heating-and-cooling cycle.

In case of the high-speed operation, the recording medium travels with a faster speed, thereby a cooling system needs larger components for a fast-cooling, which leads to a larger image forming apparatus and a cost-increase due to an addition of fast-cooling components.

In view of such background, it has been considered that satisfying the following two conditions at the same time is hard to achieve, wherein two conditions are (1) a shorter "rising-time" (i.e., energy saving), and a (2) high quality fixing which can eliminate the effect of the tiny surface irregularities on the surface of the recording medium.

SUMMARY

The present disclosure relates to a transfer-fixing unit for use in an image forming apparatus having an intermediate transfer member and a transfer-fixing unit, which includes a pressure member and a transfer-fixing member. The intermediate transfer member receives a toner image thereon. The transfer-fixing member has a deformable surface layer thereon, and directly receives the toner image from the intermediate transfer member, and transfers and fixes the toner image to a recording medium while deforming the surface layer in response to surface irregularities of the recording medium. The transfer-fixing member forms a nip portion with the pressure member and presses the recording medium at the nip portion when the recording medium passes through the nip portion with a nip time.

BRIEF DESCRIPTION OF THE DRAWINGS

A more complete appreciation of the disclosure and many of the attendant advantages and features thereof can readily be obtained and understood from the following detailed description with reference to the accompanying drawings, wherein.

DETAILED DESCRIPTION OF EXAMPLE EMBODIMENTS

Figure 1:
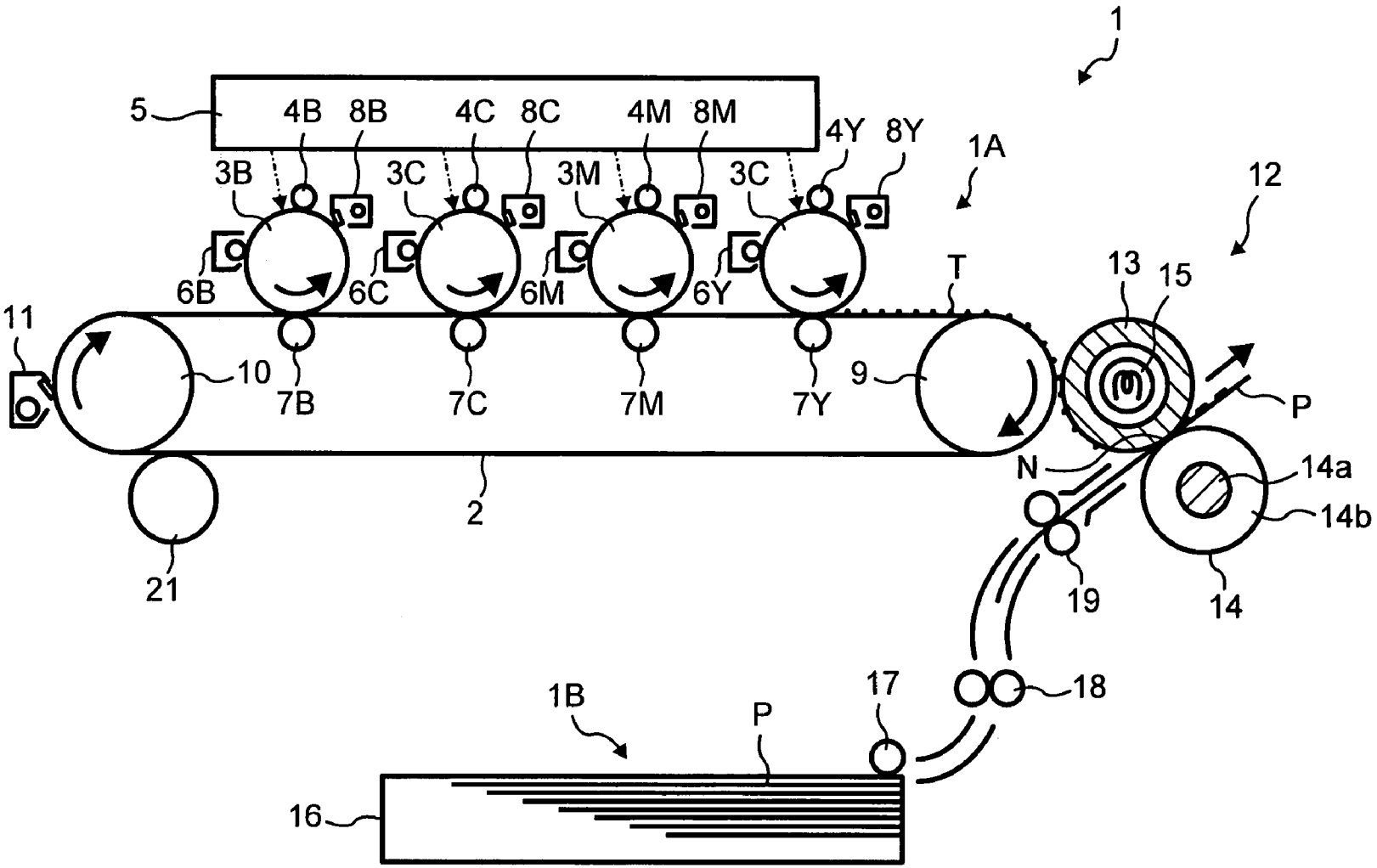
FIG. 1 is a schematic view of an image forming apparatus according to an example embodiment of the present invention.

In describing example embodiments illustrated in the drawings, specific terminology is employed for the sake of clarity. However, the disclosure of this present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, and more particularly to FIG. 1 thereof, an image forming apparatus according to one example embodiment is described.

FIG. 1 shows a schematic view of an image forming apparatus 1 according to an example embodiment of the present invention, which can be used a color copying machine.

As shown in FIG. 1, the image forming apparatus 1 includes an image forming section 1A, a sheet-feed section 1B, and an image scanning section (not shown).

The image forming section 1A includes an intermediate transfer belt 2, a charging unit 4, an optical-writing unit 5, a developing unit 6, a first transfer unit 7, a drum-cleaning unit 8, and a transfer-fixing unit 12.

The intermediate transfer belt 2 (i.e., intermediate transfer member) having a transfer surface is provided in a horizontal direction in the image forming apparatus 1, for example.

A plurality of components are provided over the intermediate transfer belt 2 to form an image on the intermediate transfer belt 2.

As shown in FIG. 1, the photoconductive members 3Y, 3M, 3C, and 3B (i.e., image carrying member), which respectively carries a yellow toner image, a magenta toner image, a cyan toner image, and a black toner image, are provided in a tandem manner along the surface of the intermediate transfer belt 2, for example.

Each of the photoconductive members 3Y, 3M, 3C, and 3B includes a drum-shape photoconductor which can rotate to a same direction (e.g., counter-clockwise direction).

As shown in FIG. 1, each of the photoconductive members 3Y, 3M, 3C, and 3B are provided with the charging unit 4, the optical-writing unit 5, the developing unit 6, the first transfer unit 7, and the drum-cleaning unit 8.

Each of the developing units 6Y, 6M, 6C, and 6B stores yellow toner, magenta toner, cyan toner, and black toner, respectively.

The intermediate transfer belt 2 is extended and driven by a drive roller 9 and a driven-roller 10, and has a nip portion with each of the photoconductive members 3Y, 3M, 3C, and 3B.

As shown in FIG. 1, the belt-cleaning unit 11, which cleans the surface of intermediate transfer belt 2, is provided at a position facing the driven-roller 10 by sandwiching the intermediate transfer belt 2 therebetween.

An image forming process in the image forming apparatus 1 is explained as below with the photoconductive member 3Y.

At first, the charging unit 4 charges the surface of the photoconductive member 3Y uniformly.

Based on image information from the image scanning section (not shown), an electrostatic latent image is formed on the photoconductive member 3Y.

The developing unit 6Y, storing yellow toner, develops the electrostatic latent image as a yellow toner image.

The first transfer unit 7Y applies a predetermined bias voltage to the toner image, and transfers the toner images to the intermediate transfer belt 2.

At other photoconductive members 3M, 3C, and 3B, similar image forming processes are conducted.

The intermediate transfer belt 2 receives toner images from each of the photoconductive members 3Y, 3M, 3C, and 3B, and such toner images from each of the photoconductive members 3Y, 3M, 3C, and 3B are superimposed on the intermediate transfer belt 2.

After transferring the toner images to the intermediate transfer belt 2, the drum-cleaning unit 8 removes toners remaining on the photoconductive member 3.

Then, a de-charging unit (not shown) de-charges the photoconductive member 3 to prepare for a next image forming process.

As shown in FIG. 1, the transfer-fixing unit 12 is provided to a position next to the drive roller 9.

The transfer-fixing unit 12 includes a transfer-fixing roller 13 and a pressure roller 14.

The transfer-fixing roller 13 receives the toner images from the intermediate transfer belt 2, and transfers the toner images to a recording medium.

As shown in FIG. 1, the transfer-fixing roller 13 and the pressure roller 14 form a nip "N" therebetween.

The transfer-fixing roller 13 includes a core, an elastic layer, and a releasing layer.

The core can be a tubular material including a metal such as aluminum. The elastic layer provided on the core can be made of silicone rubber, for example. The releasing layer can be coated on a surface of the elastic layer.

The releasing layer requires a property which can receive toner images thereon and can release toner images to a recording medium (e.g., transfer sheet) under a pressurized-condition between the releasing layer and the recording medium.

Preferably, the releasing layer has a good heat-hesitance and durability. Therefore, the releasing layer of the transfer-fixing roller 13 includes at least one of PTFE (polytetrafluoroethylene), PFA (perfluoroalkoxy), and FEP (fluorinated-ethylenepropylene), which has a heat resistance property.

As shown in FIG. 1, the transfer-fixing roller 13 also includes a heater such as halogen heater 15 to heat toner images on the transfer-fixing roller 13.

The transfer-fixing roller 13 is also proved with a thermistor (not shown) and a temperature controller (not shown). The thermistor (not shown), provided at a downstream position with respect the nip "N", senses a surface temperature of the transfer-fixing roller 13. The temperature controller (not shown) controls the "on/off" of the halogen heater 15 based on the surface temperature sensed by the thermistor. With such an arrangement, the temperature of the transfer-fixing roller 13 can be controlled.

Similar to the transfer-fixing roller 13, the pressure roller 14 includes a core 14*a*, an elastic layer 14*b*, and a releasing layer.

The core 14*a* can be a tubular material including a metal such as aluminum. The elastic layer 14*b* provided on the core can be made of silicone rubber, for example. The releasing layer coated on the surface of the elastic layer may use "Teflon" (registered trademark), for example.

As shown in FIG. 1, the sheet-feed section 1B includes a sheet-feed tray 16, a sheet-feed roller 17, sheet-transport rollers 18, and registration rollers 19.

The sheet-feed tray 16 stackingly stores a sheet "P" as a recording medium.

The sheet-feed roller 17 feeds the sheet "P" one by one from the top of the stacked sheet "P" in the sheet-feed tray 16.

The sheet-transport rollers 18 transports the sheet "P" to the registration rollers 19, and the sheet "P" is stopped at the registration rollers 19 temporally.

Then, the registration rollers 19 feeds the sheet "P" to the nip "N" by synchronizing a sheet-feed timing and a rotation of the transfer-fixing roller 13.

A bias-voltage applying unit (not shown) applies a bias-voltage to the drive roller 9, wherein the bias-voltage includes a voltage superimposed by alternative current (AC) and pulse current, for example.

With such bias-voltage, toner images "T" on the intermediate transfer belt 2 is transferred to the transfer-fixing roller 13 with an effect of electrostatic force.

As shown in FIG. 1, a cooling roller 21, made of a material having a higher heat conductivity, is provided to a position close to the drive-roller 10, and contacts the intermediate transfer belt 2 to cool the intermediate transfer belt 2.

When the cooling roller 21 is rotating, the cooling roller 21 takes off heat from the intermediate transfer belt 2, wherein such heat is conducted to the intermediate transfer belt 2 from the transfer-fixing roller 13.

With such cooling process, degradations of each of the photoconductive members 3Y, 3M, 3C, and 3B caused by the heat can be prevented.

The toner images "T," transferred to the transfer-fixing roller 13 from the intermediate transfer belt 2, receives an heat effect from the transfer-fixing roller 13, and then passes through the nip "N" so that the toner images "T" can be fixed on the sheet "P".

Under such transfer and fixing method shown in FIG. 1, the toner images "T" can be heated sufficiently in advance before the toner images "T" is fixed on the sheet "P". Such heating can be referred as pre-heating of the toner images "T".

Therefore, the transfer and fixing method shown in FIG. 1 can realize a lower fixing temperature at the fixing process compared to a conventional method that heats the toner images "T" and the sheet "P" at the same time, in such conventional method, the toner images "T" and the sheet "P" may be heated with a temperature of approximately 180° C., for example.

Based on results of experiments conducted in example embodiments, it is confirmed than a good image-quality can be obtained even when the transfer-fixing roller 13 has a relatively low temperature of from 110 to 120° C.

Hereinafter, a mechanism which may produce a lower quality image in the above-described transfer-fixing unit is explained in detail. Such lower quality image may be caused by a lower transferability which may be caused by tiny surface irregularities on the recording medium.

FIGS. 2A, 2B, 2C and 2D show expanded views explaining a relationship of the toner images "T", surfaces of the sheet "P" and the transfer-fixing roller 13.

Figure 2A:
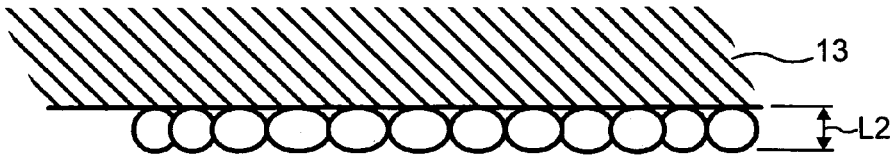
FIGS. 2A, 2B, 2C, and 2D show schematic expanded views explaining a relationship of toners, surfaces of a transfer member and recording medium.

FIG. 2A shows the surface of the transfer-fixing roller 13 having the toner images "T."

Typically, toner particles have a diameter "L2" of several micron meters (μm), and the sheet "P" has surface irregularities having a depth "L1" of 10 μm to 30 μm, for example.

The toner images "T" transferred to the transfer-fixing roller 13 are heated and melted, and then fixed on the sheet "P."

Figure 2B:
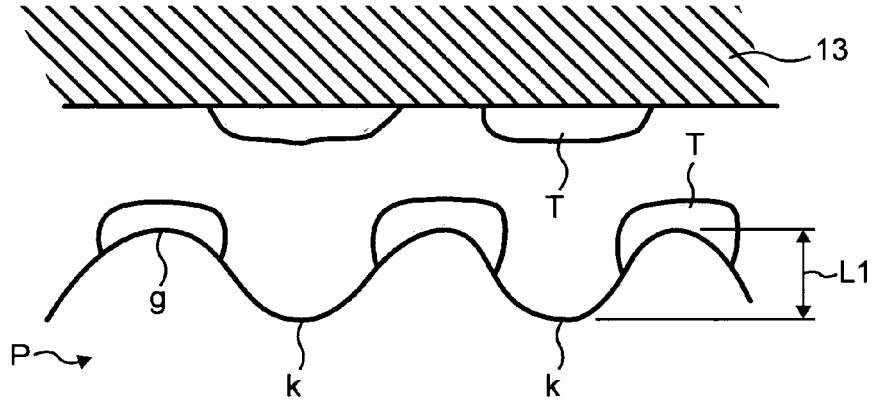
Figure 3:
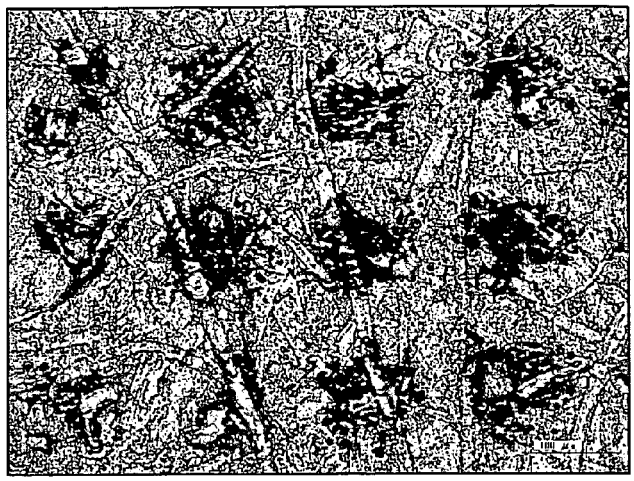
FIG. 3 is a microphotograph of toner image dot-by-dot for FIG. 2B, in which a recording medium has surface irregularities and has a poor transferability.

If the sheet "P" has larger surface irregularities as shown in FIG. 2B, the toner images "T" may contact to the sheet "P" at convexed-portions "g" but not at recessed-portions "k," which leads to a lower transferability of the toner images "T." FIG. 3 is a microphotograph corresponding to such condition shown in FIG. 2B.

Figure 2C:
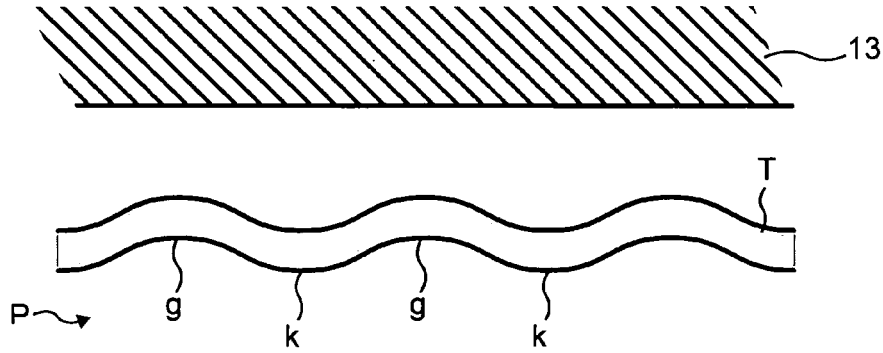
Figure 4:
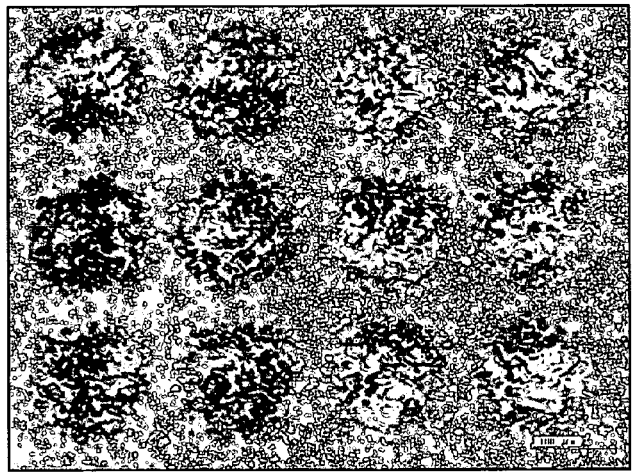
FIG. 4 is a microphotograph of toner image dot-by-dot, in which a recording medium has fewer surface irregularities and has a good transferability.

On one hand, if the sheet "P" has smaller surface irregularities as shown in FIG. 2C, the toner images "T" may contact both of the convexed-portions "g" and the recessed-portions "k" on the sheet "P," which leads to a good transferability and fix-ability of the toner images "T" on the sheet "P." FIG. 4 is a microphotograph corresponding to such condition shown in FIG. 2C.

Figure 5:
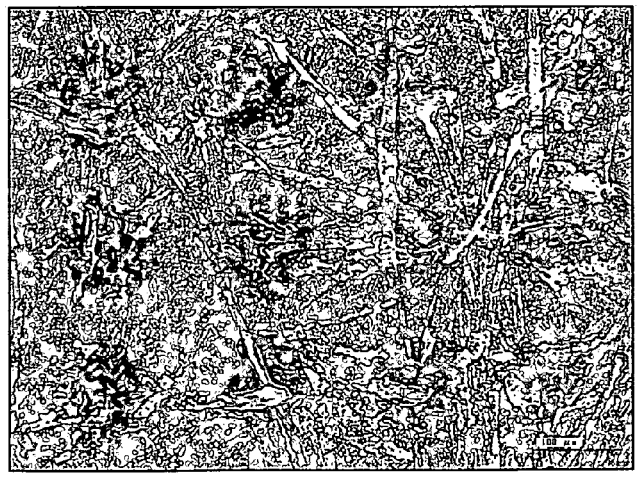
FIG. 5 is a microphotograph of toner image dot-by-dot, in which a recording medium has surface irregularities of middle level.

FIG. 5 is a microphotograph showing a toner image on a plain paper having a surface irregularities of middle level, which is between the larger surface irregularities explained with FIG. 2B and FIG. 3 and the smaller surface irregularities explained with FIG. 2C and FIG. 4.

Therefore, an improvement of the contactness of the sheet "P" and the toner images "T" leads to a good transferability and fix-ability of the toner images "T", and consequently such improvement prevents degradations of image quality.

Figure 2D:
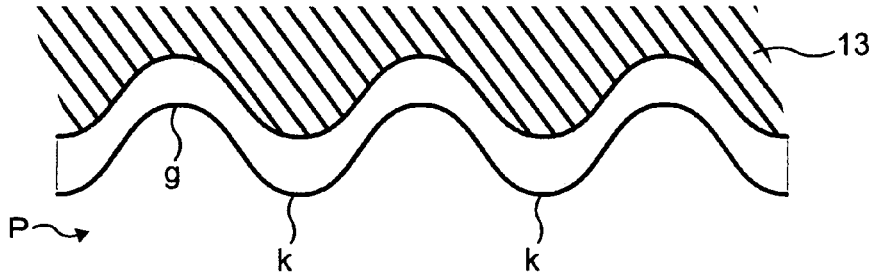

Accordingly, the transfer-fixing roller 13 preferably has a surface which can sufficiently deform its surface in response to surface irregularities "g" and "k" on the surface of the sheet "P" to contact the toner images "T" to the surface irregularities "g" and "k" closely as shown in FIG. 2D.

Therefore, the transfer-fixing roller 13 requires a surface layer having a softness which can sufficiently deform in response to tiny surface irregularities "g" and "k" on the surface of the sheet "P."

If the surface layer of the transfer-fixing roller 13 is too hard, such surface layer cannot sufficiently deform in response to tiny surface irregularities "g" and "k" on the surface of the sheet "P" even if a higher pressure is applied at the nip "N." In such a case, an favorable condition shown in FIG. 2D may not be obtained.

On one hand, if a pressure applied at the nip "N" is too low, such surface layer cannot sufficiently deform in response to tiny surface irregularities "g" and "k" on the surface of the sheet "P" even if the surface layer of the transfer-fixing roller 13 is made of a soft material.

Accordingly, in order to sufficiently deform the surface layer of the transfer-fixing roller 13 in response to tiny surface irregularities "g" and "k" on the surface of the sheet "P," a hardness of the surface layer of the transfer-fixing roller 13 and a pressure at the nip "N" are required to be adjusted at the same time.

The melted toner images "T" permeates fibers of the sheet "P" at the convexed-portions "g" with an effect of heat and pressure, and are fixed on the sheet "P."

If the toner images "T" is melted at too high temperature to lower its viscosity, some improvement of transferability and fix-ability may be observed but a good image quality may not be obtained.

If the surface layer of the transfer-fixing roller 13 can sufficiently deform in response to tiny surface irregularities "g" and "k" on the surface of the sheet "P," the surface temperature of the transfer-fixing roller 13 used for melting the toner images "T" can be set lower.

When the surface layer of the transfer-fixing roller 13 can sufficiently deform in response to tiny surface irregularities "g" and "k" on the surface of the sheet "P," the surface of the transfer-fixing roller 13 can closely contact the surface of the sheet "P," thereby the fibers of the sheet "P," and the toner images "T" can contact easily, and the melted toner images "T" can easily permeate to the fibers of the sheet "P."

Under such configuration, the temperature for melting the toner images "T" can be set to a lower value.

In order to examine a hardness of the surface layer of the transfer-fixing roller 13 in such a tiny scale, a universal hardness testing method at a microscopic level=is used instead of a usual rubber hardness testing method which examines the hardness at a macroscopic level.

Hereinafter, the universal hardness "HU," which is used for surface-hardness index of the transfer-and-fixing member (e.g., transfer-and-fixing roller 13) in example embodiment of the present invention, is explained.

The universal hardness "HU" ($N/mm^2$) is defined by dividing a test force (load) with an area of an indentation under the applied test force.

HU=(load)/(area of the indentation)

The universal hardness "HU" can be referred to the ISO (International Standardization Organization) 14577 or DIN (Deutsches Institut fur Normung) 50359.

By continuously recording "load vs. deformation" in a tiny scale area, physical properties of the surface can be examined more precisely than a usual hardness testing method.

Hereinafter, an effect of tiny surface irregularities on the recording medium to transferability of the toner images in the transfer-fixing unit 12 shown in FIG. 1 is explained.

Based on the following experiments, it is found that the universal hardness of the surface layer of the transfer-fixing roller 13 effects the transferability of the toner images.

As above-mentioned, a lower image quality may happen when the surface layer of the transfer-fixing roller 13 cannot sufficiently deform in response to tiny surface irregularities "g" and "k" on the surface of the sheet "P."

Such tiny surface irregularities "g" and "k" can be observed on the surface of the sheet "P" with a microscope as shown in FIGS. 3 to 5.

For example, an ordinal plain paper P1 (e.g., having smoothness of 23 seconds) shown in FIG. 5 has a relatively large surface irregularities of about 10 to 30 μm.

A fine paper P2 (e.g., having smoothness of 100 seconds) has surface irregularities, which is about one-half of the ordinal plain paper P1.

An art paper P3 (e.g., having smoothness of 6458 seconds) has surface irregularities which is about one-tenth of the ordinal plain paper P1.

A test method for smoothness is conducted by the "Oken-type" smoothness measurement described in JAPAN TAPPI, Paper Pulp Test No. 5-B, wherein the JAPAN TAPPI is an abbreviation of the "Japan Technical Association of the Pulp and Paper Industry."

The Paper Pulp Test No. 5-B is a standardized method set by the JAPAN TAPPI and widely used in the paper-related industries although it is not a Japanese Industrial Standard (JIS).

A thickness of toner images transferred on the sheet "P" is about 5 to 20 μm in case of color image.

Therefore, a hardness measurement of the surface layer of the transfer-fixing member conducted by the universal hardness measurement can measure hardness at a tiny scale.

In the universal hardness measurement, a hardness of the surface layer can be evaluated if the surface layer has a thickness of 1 μm or greater.

Therefore, a hardness measurement for indentation depth of 10 to 20 μm can be conducted, which is difficult to conduct by a usual rubber hardness testing method.

Based on a consideration for surface irregularities on the above-mentioned papers, the universal hardness was measured at an indentation depth of 20 μm.

Because the universal hardness of material is dependent on temperature, the universal hardness was measured at the actual fixing temperature.

Hereinafter, the universal hardness measurement conducted in an example embodiment of the present invention is described.

As for the universal hardness measurement, Fischerscope® H100 (Fischer Instruments K.K.) was used.

A fixing member was heated by a heat source such as heater and maintained at an actual fixing temperature during the measurement.

The universal hardness measurement was conducted by the Vickers hardness testing method which consists of indenting the test material with a diamond indenter (i.e., Vickers indenter) in the form of a right pyramid with a square base and an angle of 136 degrees between opposite faces.

The Vickers indenter was pressed to a surface of sample materials perpendicularly, and the universal hardness was calculated from an indenting-depth of the Vickers indenter and load.

Because the Vickers indenter has an angle of 136 degrees between opposite faces, the universal hardness "HU" is defined as below.

$$HU[N/\mathrm{mm}^2] = F[mN] \times 10^{(-3)} / \{26.43 \times (h[\mu\mathrm{m}] \times 10^{(-3)})^2\}$$
$$= (F[mN] \times 10^3) / (26.43 \times h[\mu\mathrm{m}]^2)$$

Hereinafter, experiments conducted in an example embodiment of the present invention is described.

As for the experiments, the Vickers indenter was used as a measurement indenter.

Figure 7:
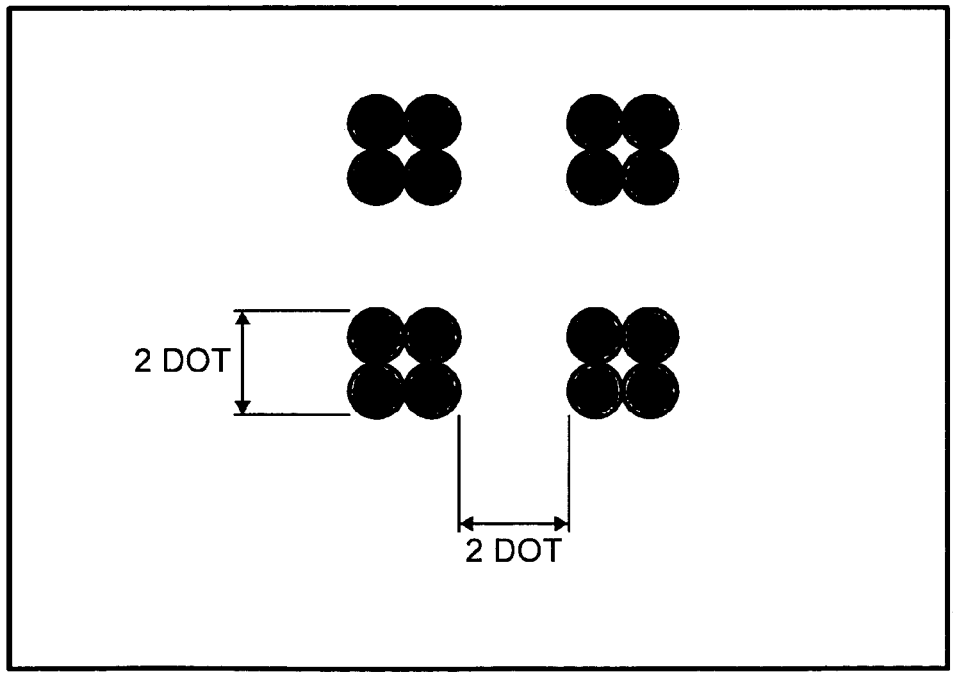
FIG. 7 is a schematic evaluation chart for evaluating transferability of toners.

FIG. 7 shows a chart used for evaluating transferability of toner images.

Under a resolution level of 600 dpi (dot per inch), an image having a plurality of "2×2-dot" groups with an equal spacing each other was formed as shown in FIG. 7.

From the experiments, it was found that the transferability for a solid image having an image concentration of 100% duty becomes favorable because cohesive power among toners and a contactness of the transfer-fixing member and the recording medium becomes larger.

Because the transferability becomes less favorable when a toner image concentration becomes smaller, transferability of the toner images was evaluated using toner images having a smaller concentration.

Hereinafter, results of the transferability of the transfer-and-fixing member (e.g., transfer-fixing roller 13) is explained.

At first, an adhesive tape is put on the transfer-fixing roller 13 before transferring the toner images to the recording medium, and then the adhesive tape is peeled to measure an first amount of the toners transferred to the transfer-fixing roller 13.

Second, toners remaining on the transfer-fixing roller 13 after transferring the toner images to the recording medium is transferred to an adhesive tape, and a second amount of the toners was measured.

From the first and second amounts, a transfer rate of toner images on the recording medium was calculated.

If the transfer rate is 90% or greater, transferability of toner images was evaluated as allowable.

As for the recording medium, a paper having larger surface irregularities (Rz=30 μm) was used, wherein Rz is ten-point height of irregularities.

The surface measurement was conducted by the Profile Micrometer VK 8500 (trademark of KEYENCE CORPORATION).

Definitions for surface roughness can be referred to JIS B 0601-2001 and ISO 4287-1997.

For example, the ten-point height of irregularities Rz is the difference between the average of the five highest peaks from the mean line and the average depth of the five deepest valleys from the mean line for a roughness curve.

In the experiments, eight transfer-and-fixing rollers which change materials and layer-thickness were used, and the universal hardness was measured for each types.

From the experiments, transfer rates were calculated and summarized as below as shown in Tables 1 to 4.

As for the toner, "EA toner" (produced by Fuji Xerox Co., Ltd.) was used. "PxP toner" (produced by Ricoh Company, Ltd.) and "S toner" (produced by Canon Inc.) were also used for toner evaluation.

Because these toner show similar behavior in a temperature rage of ±10° C. from a setting temperature, results obtained by "EA toner" is explained in detail, hereinafter.

It is known that toners, which become in an elastic state (i.e., viscosity of $10^3$ to $10^2$ Pa.s), can be fixed to a paper. Therefore, it can be understand that the above-mentioned toners, which were sufficiently heated before transferring and fixing to the paper, show a similar behavior.

If the toner is heated with too much heat, the toner may melt and result into liquid. In such a case, the viscosity of the toners becomes too low, thereby a hot-offset may happen.

On one hand, if the toner is heated with too little heat, the toners may remain powder shape, thereby the toners may not sufficiently adhere to the paper. In such a case, a color image may not be sufficiently produced on the paper.

Even though the above-mentioned toners have some differences on heat-amount and temperature required to become in an elastic state, the above-mentioned toners may have a substantially similar range of viscosity which is sufficient to permeate and fix on the paper. In such a condition, a fix-ability of toner images can be determined by a nip pressure and a nip time.

Although an average pressure (i.e., nip pressure) applied to the nip portion has an effect on the fix-ability of toner images to the recording medium (e.g., paper), the transfer-fixing roller 13 is required to sufficiently deform its surface in response to the surface irregularities of the recording medium (e.g., paper) and toner shapes so that a high quality image can be transferred on the recording medium (e.g., paper).

Therefore, a surface hardness of the surface layer of the transfer-fixing roller 13 in a tiny scale should be examined.

Conditions for Experiments:

Following conditions were used for the experiments. Some conditions such as nip time were changed to examine suitable conditions for an example embodiment of the present invention.

Transfer-Fixing Roller 13:

ϕ (diameter): 50 mm

Core: iron

Elastic layer and releasing layer: Table 1

Surface roughness: Ra=0.1 to 1.0 μm (Ra is arithmetic mean deviation of the profile)

Pressure Roller 14:

ϕ (diameter): 50 mm

Surface layer: Rubber (0.5 mm)+PFA (30 μm) (The surface layer has a harness of 94 measured by Asker C)

Core: iron

Total load: 200 N

Average nip pressure: 0.2 N/mm$^2$

Temperature: 130° C.

(The temperature satisfies the fix-ability of toner images.)

Nip time: 40 msec (standard time)

(It was confirmed that transferability is maintained at a stable level in a range of 40 to 100 msec.)

The larger the nip pressure is, the larger the transfer rate of toner images is. However, if the nip pressure is over 0.35 N/mm$^2$, an improvement of the transfer rate of toner images was not observed.

In addition, the nip pressure is preferably 0.35 N/mm$^2$ or less when considering durability and heat capacity of the members to be pressured.

The average nip pressure of the nip portion is obtained by dividing the total load (N) applied to the nip portion with an area (mm$^2$) of the nip portion.

Table 1 shows results of transfer rate. As shown in Table 1, thicknesses of the elastic layer and releasing layer were changed.

Although not shown in Table 1, the transfer-fixing roller 13 having a surface layer made of only rubber (thickness of 200 μm or 300 μm) was also used to measure the surface hardness, in which transfer-and-fixing roller 13 has a universal hardness of 0.2 N/mm$^2$.

It is preferable to obtain a universal hardness of 0.2 N/mm$^2$ as close as possible even if the releasing layer having fluorine-contained resin is proved on the elastic layer made of rubber. However, because the releasing layer having a relatively hard property is provided on the elastic layer, it is difficult to obtain a universal hardness of 0.2 N/mm$^2$ or less.

TABLE 1

| Elastic Layer Silicone rubber | | Releasing layer | Universal Hardness | Transfer |
|---|---|---|---|---|
| Thickness | JIS-A hardness | PFA Thickness | "HU" N/mm$^2$ | rate % |
| 200 μm | HS30 | 10 μm | 0.56 | 96 |
| 200 μm | HS30 | 20 μm | 1.09 | 94 |
| 200 μm | HS30 | 30 μm | 1.82 | 91 |
| 200 μm | HS30 | 50 μm | 2.65 | 82.5 |
| 300 μm | HS30 | 10 μm | 0.57 | 95 |
| 300 μm | HS30 | 20 μm | 0.98 | 94 |
| 300 μm | HS30 | 30 μm | 1.39 | 93 |
| 300 μm | HS30 | 50 μm | 2.21 | 88.5 |

From the results shown in Table 1, it was confirmed that a preferable transferability and fix-ability can be obtained when "HU" is set a value of 1.8 (N/mm$^2$) or less. Under such condition, a preferable image can be obtained.

When the transfer rate is over 95%, human eyes perceive an image as a high quality image having a less density difference, and such advantage was confirmed by a microscope observation.

Figure 8:
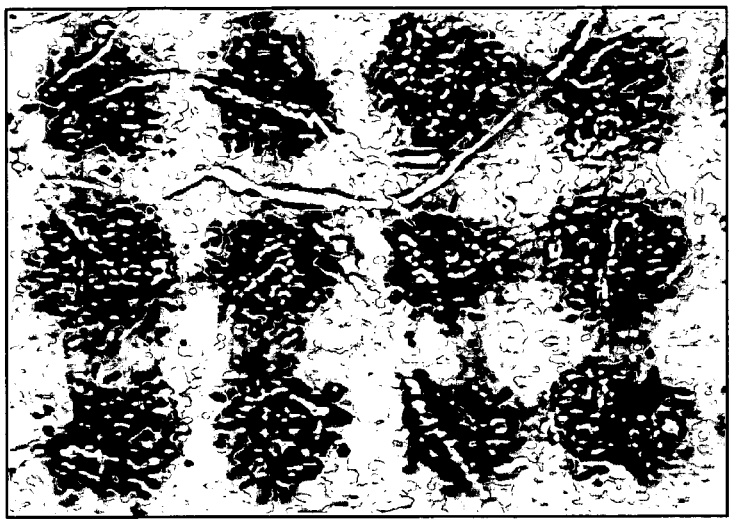
FIG. 8 is a microphotograph of toner image dot-by-dot, in which a recording medium has larger surface irregularities and a transfer member has a universal hardness of 1.09 ($N/mm^2$)

For example, FIG. 8 is a microphotograph of toner image dot-by-dot, in which a recording medium (e.g., paper) has larger surface irregularities as similar to FIG. 3 and the transfer-fixing roller 13 has the universal hardness of 1.09 (N/mm$^2$).

As shown in FIG. 8, even if a fixing was conducted with a relatively low nip pressure of 0.2 (N/mm$^2$), it was confirmed that an effect of the surface irregularities of the recording medium (e.g., paper) can be prevented.

Then another experiment was conducted under a condition of increasing a line-speed of the image forming apparatus 1, and the nip time was changed to 20 msec.

Under such condition, the transfer rate becomes below 90%.

Therefore, the total load was increased in substantially two-fold, and the average nip pressure was set to 0.35 ($N/mm^2$).

Table 2 shows the result under such corrected conditions, and Table 2 shows a similar result as Table 1.

As shown in Table 2, a transfer rate of 90% or greater was obtained when the universal hardness was 1.09 ($N/mm^2$) or less.

Furthermore, a transfer rate of 95% or greater, which is a high quality image, was obtained when the universal hardness was 0.6 ($N/mm^2$) or less.

TABLE 2

| Elastic layer Silicone rubber | | Releasing layer | Universal Hardness | Transfer |
|---|---|---|---|---|
| Thickness | JIS-A hardness | PFA Thickness | "HU" $N/mm^2$ | rate % |
| 200 μm | HS30 | 10 μm | 0.56 | 95 |
| 200 μm | HS30 | 20 μm | 1.09 | 94 |
| 200 μm | HS30 | 30 μm | 1.82 | 90 |
| 200 μm | HS30 | 50 μm | 2.65 | 82.5 |
| 300 μm | HS30 | 10 μm | 0.57 | 97 |
| 300 μm | HS30 | 20 μm | 0.98 | 94 |
| 300 μm | HS30 | 30 μm | 1.39 | 92 |
| 300 μm | HS30 | 50 μm | 2.21 | 86 |

Then another experiment was conducted by further increasing a line-speed of the image forming apparatus, in which the nip time was changed to 10 msec.

Under such condition, the transfer-and-fixing rate was below 90% when the average nip pressure was 0.35 ($N/mm^2$).

Therefore, the average nip pressure was increased to 0.50 ($N/mm^2$)

Table 3 shows the result under such correctred conditions.

As shown in Table 3, a transfer rate of 90% or greater was obtained when the universal hardness was 0.58 ($N/mm^2$) or less.

TABLE 3

| Elastic layer Silicone rubber | | Releasing layer | Universal Hardness | Transfer |
|---|---|---|---|---|
| Thickness | JIS-A hardness | PFA Thickness | "HU" $N/mm^2$ | rate % |
| 200 μm | HS30 | 10 μm | 0.57 | 93 |
| 200 μm | HS30 | 20 μm | 1.1 | 86 |
| 200 μm | HS30 | 30 μm | 1.83 | 81 |
| 200 μm | HS30 | 50 μm | 2.66 | 75 |
| 300 μm | HS30 | 10 μm | 0.58 | 91 |
| 300 μm | HS30 | 20 μm | 0.99 | 85 |
| 300 μm | HS30 | 30 μm | 1.4 | 83 |
| 300 μm | HS30 | 50 μm | 2.22 | 76 |

Then another experiment was conducted under a condition by increasing the average nip pressure to 0.6 ($N/mm^2$), in which the nip time was 10 msec.

Table 4 shows the result under such conditions.

As shown in Table 4, a transfer rate of 95% or greater, which is favorable, was obtained when the universal hardness was 0.58 ($N/mm^2$) or less.

TABLE 4

| Elastic layer Silicone rubber | | Releasing layer | Universal Hardness | Transfer |
|---|---|---|---|---|
| Thickness | JIS-A hardness | PFA Thickness | "HU" $N/mm^2$ | rate % |
| 200 μm | HS30 | 10 μm | 0.57 | 96 |
| 200 μm | HS30 | 20 μm | 1.1 | 87 |
| 200 μm | HS30 | 30 μm | 1.83 | 83 |
| 200 μm | HS30 | 50 μm | 2.66 | 80 |
| 300 μm | HS30 | 10 μm | 0.58 | 97 |
| 300 μm | HS30 | 20 μm | 0.99 | 89 |
| 300 μm | HS30 | 30 μm | 1.4 | 83 |
| 300 μm | HS30 | 50 μm | 2.22 | 82 |

To realize the above-described favorable universal hardness "HU", the releasing layer may includes PFA having a thickness of 30 μm or less, and the elastic layer may includes a silicone rubber (e.g., JIS-A HS30) having a thickness of 300 μm.

Because materials used for the releasing layer have a larger stiffness compared with materials used for the elastic layer, the releasing layer preferably has a smaller thickness which can sufficiently maintain durability of the releasing layer.

As for the silicone rubber, the smaller the thickness of the silicone rubber is, the smaller the universal hardness is.

In view of the heat capacity and heat-responsiveness, the silicone rubber preferably has a thickness of 300 μm or less.

The smaller the thickness of the releasing layer containing a fluorine-contained resin, it is preferable for reducing the universal hardness.

However, if such releasing layer is used under a higher nip pressure, the smaller thickness is not preferable in view of the durability of the releasing layer.

In such a case, a PTFE (polytetrafluoroethylene) tube 51 (see FIG. 11) can be used as for a releasing layer having a high strength, for example.

Figure 11:
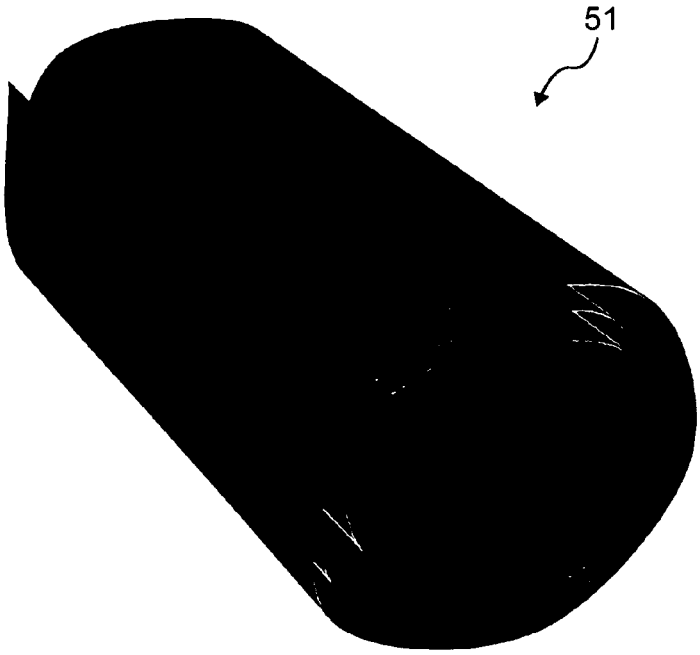
FIG. 11 is a schematic view of a resinous tube according to another example embodiment of the present invention.

As shown in FIG. 11, the PTFE tube 51 was made by rolling an extended film three times or more on a core mold, by pressing the film, and by removing the core mold from the rolled film.

As known to those skilled in the art, a tensile strength of film increases by extending the film because of orientations of resin molecules. Such extended film is formed as the PTFE tube 51.

The PTFE tube 51 having thicknesses of 10, 20, or 30 μm and the silicone rubber having thicknesses of 200 or 300 μm are combined and used for durability test.

The durability test was conducted with a continuous operating test equivalent to processing 100,000 pages.

Such combination of the PTFE tube 51 and the silicone rubber was evaluated as having a similar result using the PFA tube having a thickness of 30 μm.

The experiments conducted with the PTFE tube 51 and the silicone rubber show results as similar to Table 1.

However, if a thickness of the film for the PTFE tube 51 is 2 μm or greater, some drawbacks happens.

Because the PTFE tube 51 is made by rolling a film, the PTFE tube 51 inherently has seam area. For example, if the film is rolled about five times, a part of the surface has five layers of film, but other area may have four layers of film.

In such a case, the PTFE tube 51 has different universal hardness between a first area having a lager thickness and a second area having a smaller thickness.

If such difference of the universal hardness on the PTFE tube 51 is 0.12 $N/mm^2$ or greater on the transfer-fixing roller 13, it will lead to degradation of solid image of color, for example.

Therefore, it was confirmed that a difference of universal hardness should be 0.1 $N/mm^2$ or less.

As described above, if the transfer-fixing roller 13 can sufficiently deform its surface in response to tiny surface irregularities on the recording medium, and if the transfer-fixing roller 13 can reduce its heat capacity, a high quality fixing, a shorter "rising-time", and a lower fixing temperature can be obtained. Accordingly, an energy saving of the image forming apparatus can be achieved.

With such configuration, image quality degradations due to tiny surface irregularities on the recording medium can be prevented and a total load at the nip portion can be reduced, thereby a durability of components can be improved.

The "rising-time" of the transfer-fixing roller 13 depends on a heat capacity of components of the transfer-fixing roller 13.

If the nip pressure at the nip portion can be lowered, a strength of the components can be set to a smaller value, which leads to a smaller thickness of the core of the transfer-fixing roller 13.

Under such condition, a heat capacity of components of the transfer-fixing roller 13 can be set to a smaller value, which leads to a shorter "rising-time" of the transfer-fixing roller 13.

By using silicone rubber for the elastic layer, the surface layer of the transfer-fixing roller 13 can have a sufficient softness and heat resistance for a typical fixing temperature up to 200° C.

By maintaing the thickness of the elastic layer to 300 μm or less, a heat capacity of the transfer-fixing roller 13 can be reduced, thereby a "rising-time" can be reduced and the energy saving can be obtained.

Because the releasing layer includes at least one of PTFE, PFA, and FEP, the releasing layer can have a sufficient softness and toner-releasing property, which are required for the surface layer of the the transfer-fixing roller 13 in an oil-less fixing process.

By maintaining the thickness of the releasing layer to 30 μm or less, the transfer-fixing roller 13 can sufficiently deform its surface in response to tiny surface irregularities on the recording medium, thereby image-quality degradations can be prevented.

If toners including binding resin, colorant, and wax are used, the recording medium (e.g., paper) can be released more easily at the nip portion in an oil-less fixing process because of the wax included in toners. In such a configuration, an oil-applying device can be eliminated, thereby a cost reduction can be attained.

Toners used for the transfer-fixing unit 12 of an example embodiment includes a releasing agent dispersed in binding resin, and such releasing agent has a average particle diameter of 0.1 to 1.0 μm, for example.

Under such conditions, an adequate amount of releasing agent can be released on the toner surface during a fixing process, thereby a hot-offset can be preferably prevented.

If toners having an insufficient releasing agent is used, a stable transferability and fix-ability may not be obtained due to a hot-offset.

The releasing agent can be dispersed in an adequate size by considering compatibility of the releasing agent, resin and wax.

The releasing agent can also be dispersed in an adequately by using a dispersing agent.

The amount of releasing agent in the toner used in an example embodiment is preferably from 2 to 10 wt % (weight-%) depending on an average particle diameter of releasing agent.

If the amount of releasing agent is less than 2 wt %, a desirable hot-offset resistance is not obtained, and if the amount of releasing agent is more than 10 wt %, a developability and transferability are reduced, and a filming phenomenon on a photoconductive member and a charging unit becomes significant, thereby such conditions are not favorable.

Particle Diameter Measurement of Dispersed Releasing Agent by TEM (Transmission Electron Microscopy)

In an example embodiment, the largest particle diameter of the releasing agent is defined as the particle diameter of releasing agent.

Specifically, toners were embedded in epoxy resin, and the resin was sliced in a thickness of about 100 nm, and dyed with ruthenium tetroxide.

The resin was observed with magnifications of 10,000 to 50,000 by a TEM (transmission electron microscopy), and photographed.

By evaluating images on the photograph, dispersing conditions of 50 points of releasing agent was observed for particle diameter measurement, and the average particle diameter of the dispersed releasing agent was obtained.

The releasing agent used in an example embodiment is described as below.

As for the releasing agent, a releasing agent having a low melting point of 110° C. or less works as an effective releasing agent on a surface boundary between the transfer-fixing member and the toner image.

With such an arrangement, a hot-offset can be prevented without applying an oily material to the transfer-fixing member (e.g., transfer-fixing roller 13).

If the melting point of the releasing agent is 110° C. or greater, the releasing agent cannot work effectively.

If the melting point of the releasing agent is 30° C. or less, it is not favorable from the viewpoint of anti-blocking property and preserve-ability of toners.

In an example embodiment, the melting point of the releasing agent was measured by a DSC (differential scanning calorimetry) method with observing a maximum heat absorption peak.

Specific preferred examples of the resins for use as the binder resin in an example embodiment of the present invention include styrene polymers and substituted styrene polymers such as polyester, polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-acrylicmethyl copolymers, styrene-acrylicethyl copolymers, styrene-acrylicbutyl copolymers, styrene-acrylicoctyl copolymers, styrene-methacrylicmethyl copolymers, styrene-methacrylicethyl copolymers, styrene-methacrylicbutyl copolymers, styrene-α-chloromethacrylicmethyl copolymers, styrene-acrylonitrile copolymers, styrene-vinylmethylether copolymers, styrene-vinylethylether copolymers, styrene-vinylmethylketone copolymers, styrene-butadiene copolymers, styrene-isoprene copolymers, styrene-acrylonitrile-indene copolymers, styrene-maleic copolymers, styrene-maleate copolymers. These resins may be used alone or in combination.

As can be understand from the above-description, the transfer-fixing unit 12 itself receives toner images thereon, which is different from a conventional fixing unit that applies heat and pressure to the recording medium (e.g., paper) having toner images.

Therefore, the transfer-fixing unit 12 can be termed as a transfer-fixing type.

Figure 6:
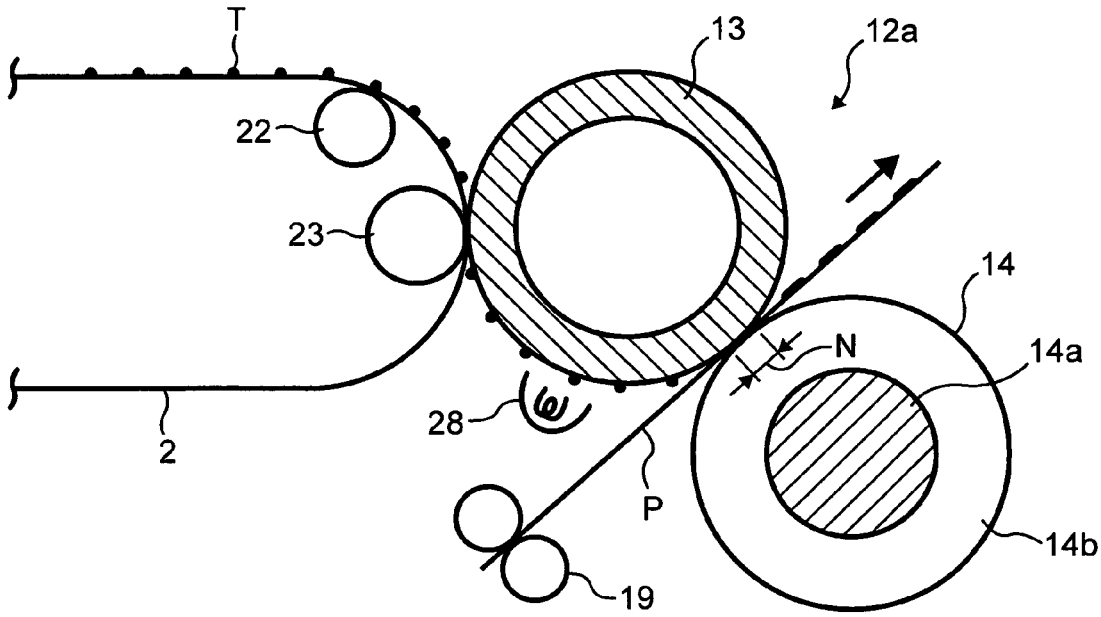
FIG. 6 is a schematic view of a transfer-fixing unit according to another example embodiment of the present invention.

FIG. 6 shows another transfer-fixing unit 12*a* using an external heat source. Explanations for components similar to the transfer-fixing unit 12 in FIG. 1 are omitted.

The transfer-fixing roller 13 includes a core made of metal such as aluminum or the like, an elastic layer having a thickness of 0.2 to 0.5 mm on the surface of the core, and a releasing layer made of fluorocarbon resin such as PFA and PTFE having a thickness of 10 to 30 μm on the elastic layer.

The pressure roller 14 also includes a similar structure as the transfer-fixing roller 13.

As shown in FIG. 6, a heat unit 28 is provided to a position, which is close to the transfer-fixing roller 13, to heat toner images on the surface layer of the transfer-fixing roller 13.

The heat unit 28 includes a reflection plate and a halogen heater, for example.

A temperature controller (not shown) controls the "on/off" of the current to the heat unit 28, and synchronizes an energization timing of the heat unit 28 with a timing of transporting toner images to an area facing the heat unit 28.

In a configuration shown in FIG. 6, the transfer-fixing roller 13 having toner images can be heated externally, thereby a "rising-time" of the transfer-fixing roller 13 can be set shorter compared to a method of heating the transfer-fixing roller 13 from the inside of the transfer-fixing roller 13.

Therefore, in a configuration shown in FIG. 6, the elastic layer can increase its thickness, thereby the transfer-fixing roller 13 can sufficiently deform its surface in response to the surface irregularities of the recording medium more easily, which results into an improved transferability of the toner images.

Furthermore, the transfer-fixing roller 13 preferably includes an insulating layer, which is provided between the elastic layer and the core, to reduce heat conduction from the heated toner images (i.e., the surface of the transfer-fixing roller 13) to the core so that a heating time of the toner images and "rising-time" of the transfer-fixing roller 13 can be reduced.

As shown in FIG. 6, a first bias member 22, and a second bias member 23 are also provided in the image forming apparatus 1.

The first bias member 22 includes a roller and functions as a guide for the intermediate transfer belt 2.

The first bias member 22 is applied with a bias voltage which has a opposite polarity of toner polarity carried on the intermediate transfer belt 2, or the first bias member 22 is connected to the earth.

The second bias member 23 faces the transfer-fixing roller 13 by sandwiching the intermediate transfer belt 2 between them.

The second bias member 23 applies a bias voltage which has a same polarity of toner polarity carried on the intermediate transfer belt 2 to transfer toner images to the transfer-fixing roller 13.

The first bias member 22 and second bias member 23 are made of an elastic material having a conductive property, and maintain a contact with the intermediate transfer belt 2 and the transfer-fixing roller 13 to prevent degradation of transfer-effectiveness.

Figure 9:
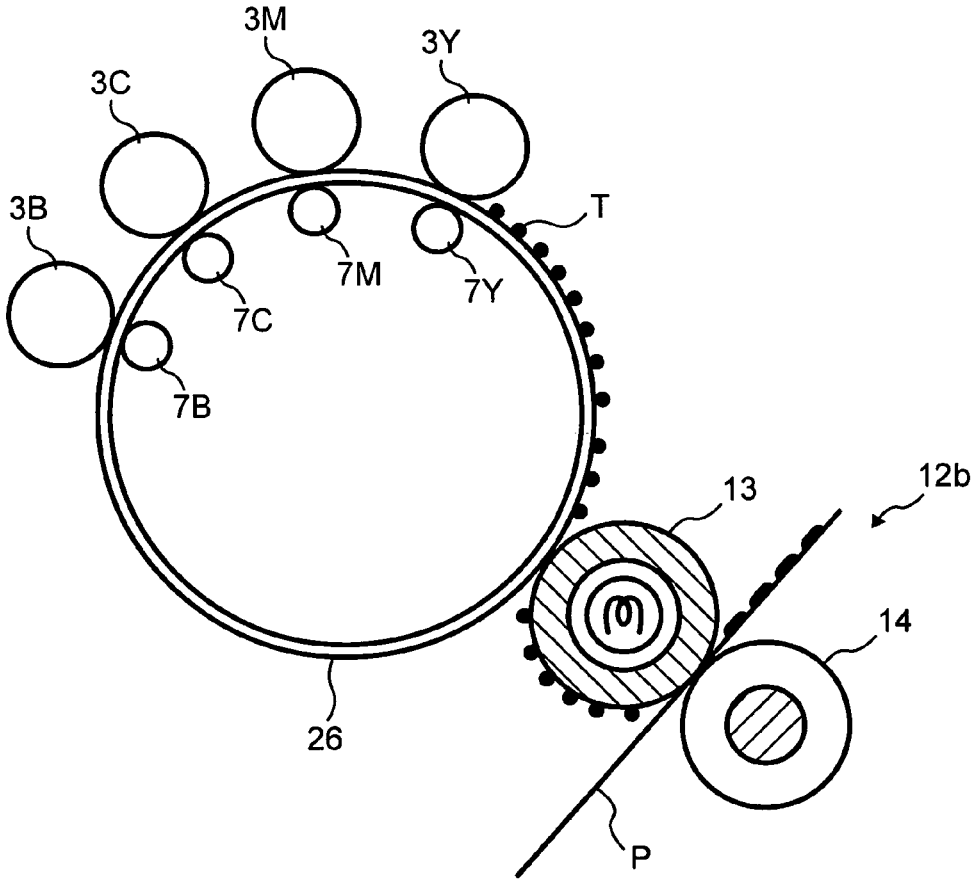
FIG. 9 is a schematic view of a transfer-fixing unit according to another example embodiment of the present invention.

FIG. 9 shows another transfer-fixing unit 12*b* using a cylinder type for the intermediate transfer member. As shown in FIG. 9, an intermediate transfer member 26 can be used, for example.

Figure 10:
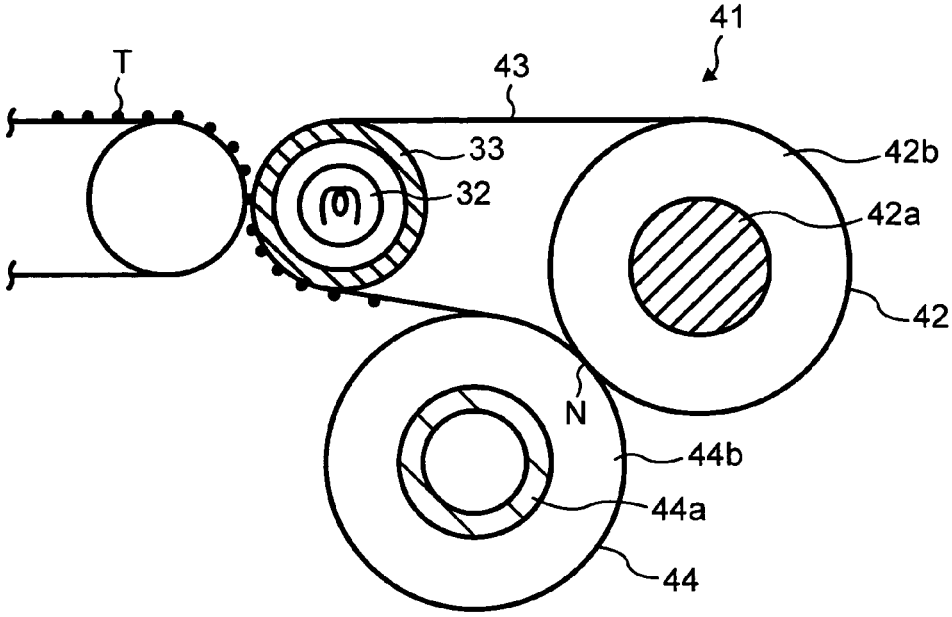
FIG. 10 is a schematic view of a transfer-fixing unit according to another example embodiment of the present invention.

FIG. 10 shows another transfer-fixing unit 41 according to another example embodiment of the present invention.

As shown in FIG. 10, the transfer-fixing unit 41 includes a heat roller 33, a support roller 42, a transfer-fixing belt 43, and a pressure roller 44.

The support roller 42 includes a core 42*a* and an elastic layer 42*b*.

The transfer-fixing belt 43 is extended by the heat roller 33 and the support roller 42.

The pressure roller 44 includes a core 44*a* and an elastic layer 44*b*.

The pressure roller 44 forms a nip "N" with the support roller 42.

Although not shown in FIG. 10, the transfer-fixing belt 43 includes a base layer, an elastic layer, and a releasing layer.

As for a material for the base layer of the transfer-fixing belt 43, an endless-type belt made of heat-resistance resinous material or metal can be used, for example.

Such heat-resistance resinous material includes polyimide, polyamide, polyetheretherketone (PEEK), for example, and such metal includes nickel, aluminum, and iron, for example.

The transfer-fixing belt 43 preferably has a thickness of 50 to 125 μm.

If the thickness of the transfer-fixing belt 43 is smaller than 50 μm, the transfer-fixing belt 43 may not obtain sufficient strength, which leads to a degradation of durability and stiffness of the transfer-fixing belt 43 that result into an unfavorable transportability by the transfer-fixing belt 43.

If the thickness of the transfer-fixing belt 43 is larger than 125 μm, a heat capacity of the transfer-fixing belt 43 may become too large, which leads to a degradation of heat-response time of the transfer-fixing unit 41.

Accordingly, a good transferability of toner images can be obtained by employing the above-described configuration for the elastic layer and the releasing layer of the transfer-fixing belt 43.

By employing a belt type for the transfer-and-fixing member, a lower heat capacity can be obtained for the transfer-fixing member.

Accordingly, a shorter "rising-time" of the image forming apparatus can be attained, and an energy saving of the image forming apparatus can be realized.

Although the transfer-fixing roller 13 and the transfer-fixing belt 43 is heated by a halogen heater in the above-described embodiment, the heat source can employ any types of heaters.

For example, the heat source includes an induced-heating unit, and an external heating configuration which heats the transfer-fixing roller 13 and the transfer-fixing belt 43 externally.

Furthermore, the above-described image forming apparatus, normally used for an office-business, can be used for other purposes.

For example, by selecting types of papers having a smooth surface (e.g., coat-paper) and using softer material for the surface layer of the transfer-fixing roller 13, an image forming apparatus can produce a photo print having a equivalent quality of conventional silver-salt photo print instead of an office-business use apparatus.

Numerous additional modifications and variations are possible in light of the above teachings. It is therefore to be understood that within the scope of the appended claims, the disclosure of the present invention may be practiced otherwise than as specifically described herein.

This application claims priority from Japanese patent applications No. 2004-202759 filed on Jul. 9, 2004, and No. 2005-025699 filed on Feb. 1, 2005 in the Japan Patent Office, the entire contents of which are hereby incorporated by reference herein.

What is claimed is:

1. An image forming apparatus, comprising:

a transfer-fixing unit configured to fix a toner image on a recording medium, including, a transfer-fixing member configured to carry the toner image, and a pressure member faced to the transfer-fixing member, wherein the transfer-fixing member includes a surface layer having a universal hardness of 0.2 $N/mm^2 < HU \leqq 1.8\ N/mm^2$ at an indentation depth of 20 μm, HU representing a universal hardness, and wherein the transfer-fixing member and the pressure member form a nip portion therebetween, the transfer-fixing member and the pressure member generate a nip pressure of 0.2 $N/mm^2$ to 1 $N/mm^2$ with a nip time of 40 msec or greater.

2. The image forming apparatus according to claim 1, wherein the surface layer of the transfer-fixing member has a universal hardness of $0.2\ N/mm^2 < HU \leqq 1.1\ N/mm^2$ at the indentation depth of 20 μm, of the transfer-fixing member.

3. An image forming apparatus, comprising:

a transfer-fixing unit configured to fix a toner image on a recording medium, including, a transfer-fixing member configured to carry the toner image, and a pressure member faced to the transfer-fixing member, wherein the transfer-fixing member includes a surface layer having a universal hardness of 0.2 $N/mm^2 < HU \leqq 1.1\ N/mm^2$ at an indentation depth of 20 μm, HU representing a universal hardness, and wherein the transfer-fixing member and the pressure member form a nip portion therebetween, the transfer-fixing member and the pressure member generate a nip pressure of 0.35 $N/mm^2$ to 1 $N/mm^2$ with a nip time of 20 msec or greater.

4. The image forming apparatus according to claim 3, wherein the surface layer of the transfer-fixing member has a universal hardness of $0.2\ N/mm^2 < HU \leqq 0.6\ N/mm^2$ at the indentation depth of 20 μm.

5. An image forming apparatus, comprising:

a transfer-fixing unit configured to fix a toner image on a recording medium, including, a transfer-fixing member configured to carry the toner image, and a pressure member faced to the transfer-fixing member, wherein the transfer-fixing member includes a surface layer having a universal hardness of 0.2 $N/mm^2 < HU \leqq 0.6\ N/mm^2$ at an indentation depth of 20 μm, HU representing a universal hardness, and wherein the transfer-fixing member and the pressure member form a nip portion therebetween, the transfer-fixing member and the pressure member generate a nip pressure of 0.5 $N/mm^2$ to 1 $N/mm^2$ with a nip time of 10 msec or greater.

6. The image forming apparatus according to claim 5, wherein the transfer-fixing member and the pressure member generate a nip pressure of 0.6 $N/mm^2$ to 1 $N/mm^2$ with the nip time of 10 msec or greater.

7. The image forming apparatus according to claim 1, wherein the transfer-fixing member further comprises:

an elastic layer formed of an elastic material; and a releasing layer, formed on the elastic layer, configured to carry the toner image and release the toner image to the recording medium.

8. The image forming apparatus according to claim 7, wherein the elastic layer of the transfer-fixing member has a thickness of 200 μm to 1,000 μm and a JIS-A rubber hardness of HS5 to HS30, and the releasing layer of the transfer-fixing member has a thickness of 1 μm to 30 μm.

9. The image forming apparatus according to claim 1, wherein the transfer-fixing member includes a first heat source configured to indirectly heat the surface layer of the transfer-fixing member.

10. The image forming apparatus according to claim 1, further comprising:

a second heat source configured to directly heat the surface layer of the transfer-fixing member.

11. The image forming apparatus according to claim 1, wherein the transfer-fixing member includes an elastic layer having a thickness of 300 μm or less.

12. The image forming apparatus according to claim 1, wherein the transfer-fixing member includes a releasing layer having a thickness of 30 μm or less.

13. The image forming apparatus according to claim 1, wherein the transfer-fixing member includes a releasing layer including at least one of polytetrafluoroethylene (PTFE) resin, perfluoroalkoxy (PFA) resin, and fluorinated-ethylenepropylene (FEP) resin.

14. The image forming apparatus according to claim 1, wherein the transfer-fixing member includes a releasing layer having a tubular shape, which is made by rolling a film of polytetrafluoroethylene (PTFE) resin, the rolled film of polytetrafluoroethylene (PTFE) resin is formed by applying heat at a temperature lower than a melting point of the polytetrafluoroethylene (PTFE) resin, and a difference of the universal hardness at a first area having a larger thickness and a second area having a smaller thickness on a surface of the rolled film at the indentation depth of 20 μm is 0.1 $N/mm^2$ or less.

15. The image forming apparatus according to claim 1, wherein the toner image includes a binding resin, a colorant, and a wax.

16. The image forming apparatus according to claim 1, wherein the toner image includes a binding resin, a colorant, and a releasing agent which is dispersed in the binding resin and has an average particle diameter of 0.1 μm to 1.0 μm.

17. The image forming apparatus according to claim 1, wherein the transfer-fixing member is a belt.

18. The image forming apparatus according to claim 1, wherein the surface layer of the transfer-fixing member has a universal hardness of 1.8 $N/mm^2$ or less at a fixing temperature set for the transfer-fixing member.

19. An image forming apparatus, comprising:

a transfer-fixing unit configured to fix a toner image on a recording medium, including, a transfer-fixing member configured to carry the toner image, and a pressure member faced to the transfer fixing member, wherein the transfer-fixing member includes an elastic layer having a thickness of 200 μm to 1,000 μm and the elastic layer has a JIS-A rubber hardness of HS5 to HS30, and the transfer-fixing member has a releasing layer having a thickness of 1 μm to 30 μm.

20. The image forming apparatus according to claim 19, wherein the releasing layer of the transfer-fixing member has a thickness of 1 μm to 20 μm.

21. The image forming apparatus according to claim 19, wherein the releasing layer of the transfer-fixing member has a thickness of 1 μm to 10 μm.

22. The image forming apparatus according to claim 19, wherein the elastic layer includes an elastic material that has a heat resistance property for a temperature of 200 degree Celsius.

* * * * *